US007073963B2

(12) United States Patent
Neri

(10) Patent No.: US 7,073,963 B2
(45) Date of Patent: Jul. 11, 2006

(54) FILM SUPPORT DEVICES AND PRINTING SYSTEM HANDLING INK FILM FOR PRINTING

(75) Inventor: Joel Neri, Youngstown, NY (US)

(73) Assignee: International Imaging Materials, Inc., Amherst, NY (US)

( * ) Notice: Subject to any disclaimer, the term of this patent is extended or adjusted under 35 U.S.C. 154(b) by 0 days.

(21) Appl. No.: 10/695,838

(22) Filed: Oct. 30, 2003

(65) Prior Publication Data

US 2005/0095048 A1 May 5, 2005

(51) Int. Cl.
*B65H 75/00* (2006.01)

(52) U.S. Cl. ..... 400/242; 400/207; 400/236; 400/236.2; 242/355; 242/358.1; 242/597.6

(58) Field of Classification Search ..... 400/242, 400/225, 226, 235, 236, 207, 208, 208.1; 242/358.1, 358, 597.6, 355
See application file for complete search history.

(56) References Cited

U.S. PATENT DOCUMENTS 4,505,603 A * 3/1985 Yana ..... 400/120.04
4,616,945 A * 10/1986 Komplin ..... 400/697.1
4,925,127 A * 5/1990 Outou et al. ..... 242/355
5,433,539 A * 7/1995 German ..... 400/225
5,548,368 A * 8/1996 Lee et al. ..... 396/515
5,620,265 A * 4/1997 Kondo ..... 400/196
5,695,292 A * 12/1997 Coote ..... 400/250
5,859,755 A * 1/1999 Griffin et al. ..... 360/128
5,870,644 A * 2/1999 Naka et al. ..... 396/512
6,257,780 B1 * 7/2001 Ito et al. ..... 400/208
6,543,945 B1 4/2003 Nakashima et al.
6,624,836 B1 * 9/2003 Sakuta et al. ..... 347/214
6,659,664 B1 * 12/2003 Holland et al. ..... 400/207

FOREIGN PATENT DOCUMENTS

JP 61053072 A * 3/1986
JP 61121979 A * 6/1986
JP 63221076 A * 9/1988

* cited by examiner

*Primary Examiner*—Daniel J. Colilla
*Assistant Examiner*—Dave A. Ghatt
(74) *Attorney, Agent, or Firm*—Dickstein Shapiro Morin & Oshinsky LLP

(57) ABSTRACT

A system is provided for movably supporting an ink film in a printer. The system has cylindrical supply and take-up cores for supporting and taking up the film during printing operations. The cores may be made of molded plastic resin. The ends of the cores are sized to selectively fit within a frame in such a way as to provide stable operation, including where applicable, while a frame cover is closed. In a preferred embodiment, the diameters of the first and second ends of the supply and take-up cores are essentially the same, and the diameters of the second and first ends of the respective cores are essentially the same. A molded cylindrical brake portion frictionally contacts the teeth of a brake gear to provide the desired film tension with improved handling and with reduced likelihood of jamming.

12 Claims, 2 Drawing Sheets

FILM SUPPORT DEVICES AND PRINTING SYSTEM HANDLING INK FILM FOR PRINTING

BACKGROUND OF THE INVENTION

The present invention relates generally to devices for supporting a flexible film in a printer or the like. The invention also relates to systems for handling flexible sheet material, and methods of selectively providing ink film for printing.

SUMMARY OF INVENTION

The present invention relates to a system for movably supporting a film, such as an ink film (which may be a contrast agent film) or another suitable transfer medium. According to one aspect of the invention, the system may be used to support the film within suitable packaging such as for display, storage and/or sale. In addition, the system may be used to wind or reel the film in an operative, movable manner within a printer, for example one located within a facsimile machine. The system may be used, for example, to support a film within a printer of the type shown in U.S. Pat. No. 6,543,945.

According to a preferred embodiment of the invention, the film support system is made up of first and second rotatable devices, each having first and second ends. The first device may be used to supply the film; the second device may be used to take up or otherwise receive the film from the first device. In the preferred embodiment, the devices may be hollow molded cores.

According to another aspect of the invention, the diameter of the first end of the second rotatable device may be essentially the same as that of the second end of the first device, and the diameter of the second end of the second device may be essentially the same as that of the first end of the first device. If desired, the first end of the first device may have a greater diameter than the second end of the first device. If desired, the diameters of the ends may be selected, relative to corresponding support structures in the printer, to provide a quality control function, to ensure that inferior film products are not installed in the printer, and/or to ensure that film is easily installed in the printer in the proper orientation.

According to yet another aspect of the invention, a cylindrical brake portion may be provided for frictionally contacting, but not meshing with, a brake gear in the printer, to apply a back tension to the ink film as it is pulled onto the take-up device. In a preferred embodiment, the brake portion is integrally molded as part of the supply device. The cylindrical exterior surface of the brake portion may be concentric with other cylindrical exterior surfaces of the supply device.

According to another aspect of the invention, the supply and take-up devices may be used to locate the film within a printer or other machine. If desired, the ends of the supply and take-up devices may be located in suitable support structures or devices, such as, for example, the semi-cylindrical support sections shown in U.S. Pat. No. 6,543,945. According to a preferred embodiment of the invention, a cover may be moved onto the ends of the supply and take-up devices after the ends are located in the support devices, and a take-up gear within the machine may be used to drive the take-up device to take up the film from the supply device. If desired, the brake gear may be used to apply friction to the supply device, to thereby generate tension within the extended portion of the ink film, while the take-up (drive) gear is rotated.

These and other objects and advantages of the invention may be best understood with reference to the following detailed description of preferred embodiments of the invention, the appended claims and the several drawings attached hereto.

DETAILED DESCRIPTION OF PREFERRED EMBODIMENTS

Figure 1:
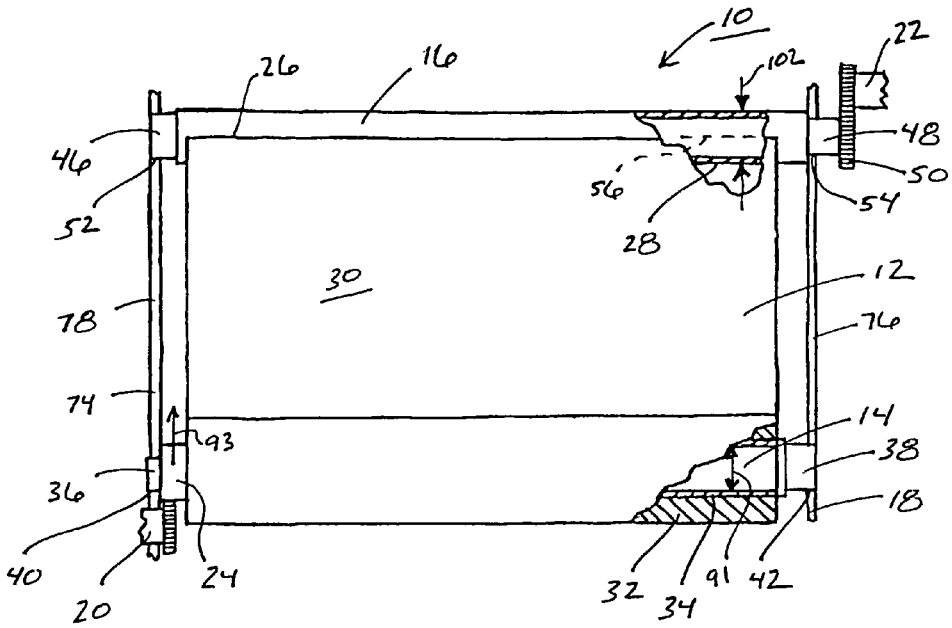
FIG. 1 is a partially broken away plan view of an ink ribbon supply system constructed in accordance with a preferred embodiment of the invention, with a cover removed.

Referring now to the drawings, where like elements are designated by like reference numerals, there is shown in FIG. 1 a film support system 10 constructed in accordance with a preferred embodiment of the present invention. A detailed description of the illustrated system 10 is provided below. The present invention should not be limited, however, to the specific features of the illustrated system 10.

The film support system 10 has an ink film 12, a supply core 14, a take-up core 16, and a frame 18. Rotation of the supply core 14 is braked (that is, resisted but not prevented) by a brake gear 20. The take-up core 16 is rotated by a drive gear 22. In operation, rotation of the drive gear 22 causes the film 12 to be taken up around the take-up core 16 while tension is generated within the film 12 by friction between the brake gear 20 and a cylindrical brake portion 24 of the supply core 14.

The film 12 may be formed of a known flexible sheet-like or ribbon printing medium. The illustrated film 12 contains a flexible backing material and a suitable contrast agent such as colored or black ink. A leading edge 26 of the film 12 may be attached to a main portion 28 of the take-up core 16. An extended portion 30 of the film 12 is stretched between the cores 14, 16. The remainder 32 of the film 12 is wound around the main portion 34 of the supply core 14. The width of the film 12 is such that it covers all or most of the main portions 28, 34 of the cores 14, 16. In a preferred embodiment, the extended film portion 30 is positioned in a printer of a facsimile machine to be operated upon by a printer head (not shown) or the like. As the extended portion 30 is wound around the take-up core 16, a new extended portion is drawn off from the supply core 14, such that a fresh film portion is periodically or continuously moved into position adjacent the printer head as desired.

The illustrated supply core 14 is a single piece of integrally molded plastic. The core 14 has first and second ends 36, 38 in addition to the brake and main portions 24, 34. The four supply core portions 24, 34, 36, 38 have cylindrical exterior surfaces that are concentric with each other. The main portion 34 is located between and is contiguous with the brake portion 24 and the second end 38. The brake portion 24 is located between and is contiguous with the first end 36 and the main portion 34.

When the system 10 is assembled within a printer, the first and second ends 36, 38 fit into respective semi-cylindrical, upwardly open support sections 40, 42 (FIGS. 2 and 3) in the frame 18, and the brake portion 24 is in frictional contact with the brake gear 20. The supply core ends 36, 38 are settled into and rotatably supported on the support sections 40, 42, such the frame 18 aligns the centerline 44 of the core 14 on the desired axis of rotation. The brake portion 24 may slip over the brake gear 20 to prevent the system 10 from becoming jammed or stuck as a result of contaminants in the brake gear 20, or as a result of a malfunction of the brake gear 20. In addition, since the brake portion 24 does not have any teeth, it is easy to smoothly locate and remove the system 10 from its printing position. That is, an advantage of the illustrated system 10 is that it is not necessary to mesh any teeth into the teeth of the brake gear 20.

The take-up core 16 is a single piece of molded plastic, with first and second ends 46, 48 (FIG. 1) and an integrally molded gear 50. The main portion 28 of the take-up core 16 is located between and is contiguous with the first and second ends 46, 48. The second end 48 is located between and is contiguous with the main portion 28 and the molded gear 50. The ends 46, 48 and the main portion 28 have cylindrical exterior surfaces that are concentric with each other and with the teeth of the molded gear 50.

When the system 10 is assembled within the printer, the take-up core ends 46, 48 fit into respective semi-cylindrical, upwardly open support sections 52, 54 of the frame 18, and the teeth of the molded gear 50 are meshed with the teeth of the drive gear 22. The take-up core ends 46, 48 are settled into and rotatably supported on the support sections 52, 54 such that the frame 18 maintains the centerline 56 of the take-up core 16 on the desired axis of rotation.

Figure 2:
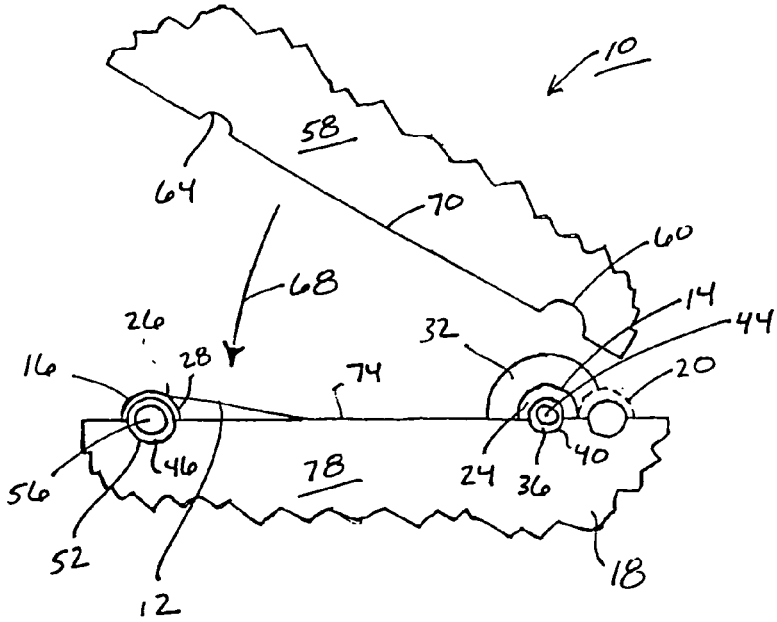
FIG. 2 is a partially broken away left side view of the supply system of FIG. 1, with the cover in an intermediate position, moving toward an operative, closed position.
Figure 3:
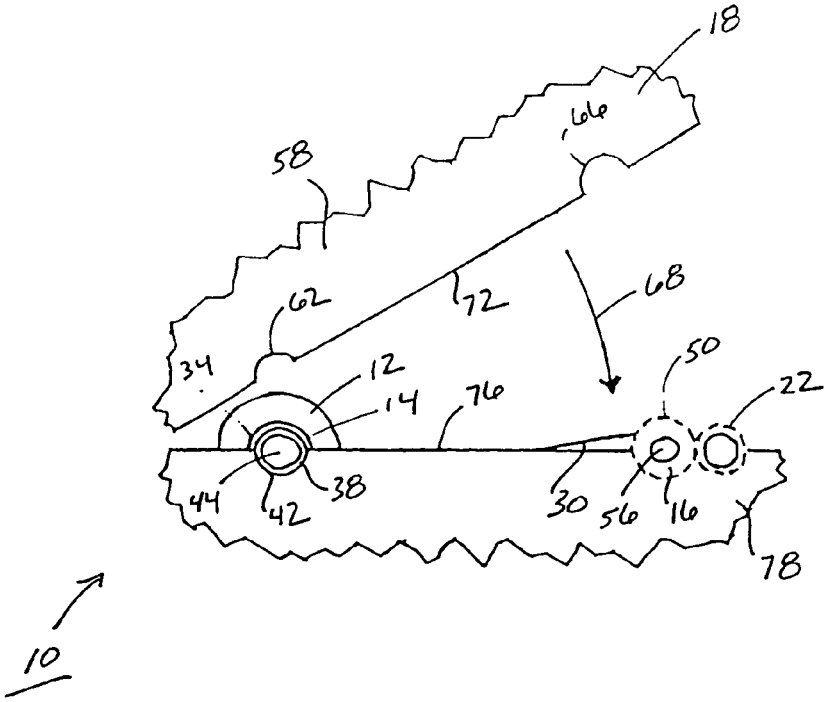
FIG. 3 is a partially broken away right side view of the supply system of FIG. 1, with the cover in its intermediate position.

As shown in FIGS. 2 and 3, the frame 18 has a movable cover 58 with semi-cylindrical openings 60, 62, 64, 66 for covering the support sections 40, 42, 52, 54 to fully enclose the respective ends 36, 38, 46, 48 of the cores 14, 16. The cover 58 has an open position, an intermediate position and a closed position. When the cover 58 is in its open position (not shown), the cores 14, 16 and film 12 can be moved into or removed from the support sections 40, 42, 52, 54, for example to replace a spent or damaged film 12. The cover 58 is shown in FIGS. 2 and 3 in its intermediate position, moving in the direction of arrow 68 from the open position to the closed position.

In the closed position (not shown), the lower-most edges of the downwardly open semi-cylindrical cover openings 60–66 match the upper-most edges of the support sections 40, 42, 52, 54 to form smooth, encircling, rotation-facilitating axle connections between the core ends 36, 38, 46, 48 and the frame 18. In this way, the cover 58 contributes to the positional maintenance of the core centerlines 44, 56 on the desired axes of rotation. In the closed position, lower guide edges 70, 72 of the cover 58 rest on corresponding guide edges 74, 76 of the lower portion 78 of the frame 18.

If desired, the frame 18, including the cover 58, may be constructed generally like the frame (or case) and cover shown in U.S. Pat. No. 6,543,945. According to a preferred embodiment of the invention, and as discussed in more detail below, the lengths and diameters of the core ends 36, 38, 46, 48 are sized to provide stable positioning and rotatability within the frame 18 while the cover 58 is in its closed position.

According to one aspect of the invention, however, the radial dimensions of the core ends 36, 38, 46, 48 are not necessarily the same as and do not necessarily match the radial dimensions of the corresponding frame enclosures 40, 60, 42, 62, 52, 64, 54, 66. If desired, the frame 18, including the cover 58, may be sized to operatively receive supply and take-up cores that are substantially different than the ones described in the present specification.

Figure 4:
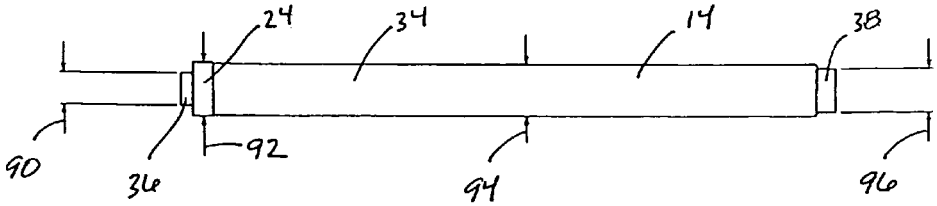
FIG. 4 is a plan view of the supply core of the supply system of FIG. 1, with the ink ribbon removed.

Referring now to FIG. 4, the diameter 90 of the first end 36 of the supply core 14 may be in the range of from about 0.440 inches to about 0.500 inches. In the illustrated embodiment, the first end diameter 90 is about 0.470 inches. The inner diameter 91 (FIG. 1) of the hollow core 14 is selected to provide sufficient wall strength without using an excessive amount of plastic material.

The diameter 92 (FIG. 4) of the brake portion 24 is such that the desired friction is applied to the ends of the teeth of the brake gear 20 during operation. The brake portion diameter 92 is greater than the first end diameter 90. For example, the brake portion diameter 92 may be in the range of from about 0.750 inches to about 0.810 inches. In the illustrated system 10, the brake portion diameter 92 is about 0.780 inches.

Note that the brake portion diameter 92 is preferably selected such that the brake portion 24 is biased in a first direction 93 (FIG. 1) by pressure applied by the brake gear 20, while the first supply core end 36 is biased in the opposite direction by pressure applied by the encircling frame connection 40, 60. The friction generated where the first supply core end 36 rotatably slides within the frame 40, 60 supplements the friction applied to the supply core 14 by the brake gear 20, and contributes to the stable tension-generating braking operation of the film system 10.

The diameter 94 of the supply core main portion 34 may be less than the diameter 92 of the brake portion 24. The main portion diameter 94 is selected to provide the desired room for the wound up film 12, 32. In addition, the relative diameters 92, 94 of the brake portion 24 and the main portion 34 should be arranged to provide the desired tension to the extended film portion 30 during printing. The main portion diameter 94 may be, for example, in the range of from about 0.720 inches to about 0.780 inches. In the illustrated embodiment, the main portion diameter 94 is about 0.750 inches.

The diameter 96 of the second end 38 of the supply core 14 may be greater than the first end diameter 90, to provide for rotation of the supply core 14 in a stable condition within the frame 18. The difference between the end diameters 90, 96 may also be used to provide a quality control function, to ensure that inferior film products are not installed in the printer, and/or to ensure that film is easily installed in the printer in the proper orientation. The main portion diameter 94 is greater than the second end diameter 96 so that the main portion 34 does not tend to slip into the frame opening 42, 62. The second end diameter 96 may be for example, in the range of from about 0.600 inches to about 0.660 inches. In the illustrated embodiment, the second end diameter 96 is about 0.630 inches.

Figure 5:
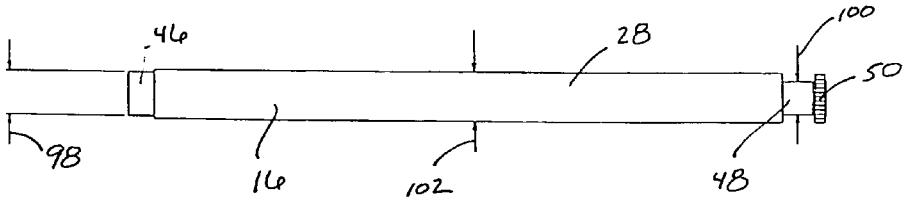
FIG. 5 is a plan view of the take-up core of the supply system of FIG. 1, with the ink ribbon removed.

Referring now to FIG. 5, the diameter 98 of the first take-up core end 46 may be essentially the same as the diameter 96 of the second supply core end 38. In particular, to provide the desired fit, selective assembly and stable rotation in the frame 18, the diameter 98 of the first take-up core end 46 should be closer to the diameter 96 of the second supply core end 38 than to the diameters 90, 100 of the other core ends 36, 48. In the illustrated embodiment, the diameter 98 of the first take-up core end 46 is in the range of from about 0.600 inches to about 0.660 inches, more preferably, the diameter 98 is about 0.630 inches.

The diameter 102 of the main portion 28 of the take-up core 16 may be much greater than the diameter 98 of the contiguous first end 46, but less than the main portion diameter 94 of the other core 14. For each core 14, 16, the main portion diameters 94, 102 should be essentially uniform across the entire lengths of the main portions 28, 34. Further, the diameter 102 of the main take-up portion 28 should be sized relative to the teeth of the molded gear 50 to provide the desired driving force (torque in the film winding direction). The take-up core main portion diameter 102 may be, for example, in the range of from about 0.675 inches to about 0.735 inches. In the illustrated embodiment, the take-up core main portion diameter 102 is about 0.705 inches.

The diameter 100 of the take-up core second end 48 may be less than the diameter 98 of the take-up core first end 46, to thereby rotate in a stable condition as desired within the corresponding frame opening 54, 66. The take-up core second end diameter 100 may be essentially the same as the supply core first end diameter 90. In particular, to provide the desired fit, selective assembly and stable rotation in the frame 18, the take-up core second end diameter 100 should be closer to the supply core first end diameter 90 than to the diameters 96, 98 of the other core ends 38, 46. The take-up core main portion diameter 102 may be greater than the take-up core second end diameter 100 so that the take-up core main portion 28 does not tend to slip into the frame opening 54, 66. The take-up core second end diameter 100 may be, for example, in the range of from about 0.440 inches to about 0.500 inches. In the illustrated embodiment, the take-up core second end diameter 100 is about 0.470 inches.

In operation, the system 10 may be stored, handled and marketed in a suitable package (not shown). During such storage, the cores 14, 16 are located close to each other. Once the system 10 is removed from the package, the cores 14, 16 are moved away from each other, such that the film 12 unwinds partially from the supply core 14 to form the extended portion 30 between the two cores 14, 16. While the printer cover 58 is in its open position, the core ends 36, 38, 46, 48 are placed into and maintained by gravity within the upwardly open support sections 40, 42, 52, 54. Then the cover 58 is rotated (68) into its closed position, such that the core ends 36, 38, 46, 48 are enclosed within the circular frame openings 40, 60, 42, 62, 52, 64, 54, 66. At this stage, the molded gear 50 is meshed with the drive gear 22, the cylindrical brake portion 24 is in frictional contact with the brake gear 20, and the extended film portion 30 is located adjacent the printing head.

During printing, the film 12 is periodically and/or progressively transferred onto the take-up core 16 until all or most of the film 12 is wound around the take-up core 16. Then the cover 58 is returned to its open position, the cores 14, 16 and film 12 are removed from the frame 18, and a new system 10 is positioned within the frame 18 for further printing operations.

The above description and drawings are only illustrative of preferred embodiments which can achieve and provide the objects, features and advantages of the present invention. It is not intended that the invention be limited to the embodiments shown and described in detail herein. Modifications coming within the spirit and scope of the following claims are to be considered part of the invention.

What is claimed as new and desired to be protected by Letters Patent of the United States is:

1. A system for supporting a film, said system comprising:

a first device provided as a single piece arranged and configured to locate the first device in a frame and having a first end and a second end, each of said ends having a diameter, wherein said first device does not comprise an operative gear; and a second device for rotatably receiving the film from the first device, said second device having a first end and a second end, a gear attached to said second end, and wherein each of said ends of said second device has a diameter; and wherein said diameter of said first end of said second device is essentially the same as said diameter of said second end of said first device, and said diameter of said second end of said second device is essentially the same as said diameter of said first end of said first device.

2. The system of claim 1, wherein said diameter of said first end of said second device is greater than said diameter of said second end of said second device.

3. The system of claim 2, further comprising a smooth cylindrical brake portion for frictionally contacting a brake gear to resist rotation of said first device.

4. The system of claim 3, wherein said brake portion is located adjacent to said first end of said first device.

5. An ink film supply system, comprising:

a supply core formed as a single piece having a first cylindrical end and a second cylindrical end, each of said ends having an exterior diameter, and wherein said exterior diameter of said second cylindrical end is greater than said exterior diameter of said first cylindrical end, and said supply core does not comprise an operative gear;

a take-up core for taking up ink film from said supply core, said take-up core having a first end and a second end, and wherein each of said ends of said take-up core has an exterior diameter; and wherein said exterior diameter of said first end of said take-up core is essentially the same as said exterior diameter of said second end of said supply core, and said exterior diameter of said second end of said take-up core is essentially the same as said exterior diameter of said first end of said supply core, and a gear on said second end of said take-up core.

6. The system of claim 5, said supply core further comprising a molded brake portion having a smooth, cylindrical outer surface arranged and configured to frictionally contact a brake gear.

7. The system of claim 6, wherein said brake portion is located between a main portion of said supply core and said first end of said supply core.

8. The system of claim 7, wherein said gear on said take-up core includes a molded gear for meshing with a drive gear, such that rotation of said drive gear causes said take-up core to take up the ink film from said supply core.

9. The system of claim 8, wherein said second end of said take-up core is located between said molded gear and a main portion of said take-up core.

10. The system of claim 9, wherein said cores are formed of hollow molded plastic.

11. An ink film supply system, comprising:

a supply core having a first cylindrical end and a second cylindrical end, each of said ends having an exterior diameter, and wherein said exterior diameter of said second cylindrical end is greater than said exterior diameter of said first cylindrical end, and said supply core does not comprise an operative gear, said supply core further comprising a smooth, cylindrical molded brake portion located between a main portion of said supply core and said first end of said supply core for frictionally contacting a brake gear;

a take-up core for taking up ink film from said supply core, said take-up core having a first end and a second end, and wherein each of said ends of said take-up core has an exterior diameter; and wherein said exterior diameter of said first end of said take-up core is essentially the same as said exterior diameter of said second end of said supply core, and said exterior diameter of said second end of said take-up core is essentially the same as said exterior diameter of said first end of said supply core, and a gear on said second end of said take-up core, and wherein said brake portion has a diameter larger than said diameter of said first end of said supply core.

12. An ink film supply system, comprising:

a supply core having a first cylindrical end and a second cylindrical end, each of said ends having an exterior diameter, and wherein said exterior diameter of said second cylindrical end is greater than said exterior diameter of said first cylindrical end, and said supply core does not comprise an operative gear, said supply core further comprising a smooth, cylindrical molded brake portion located between a main portion of said supply core and said first end of said supply core for frictionally contacting a brake gear;

a take-up core for taking up ink film from said supply core, said take-up core having a first end and a second end, and wherein each of said ends of said take-up core has an exterior diameter; and wherein said exterior diameter of said first end of said take-up core is essentially the same as said exterior diameter of said second end of said supply core, and said exterior diameter of said second end of said take-up core is essentially the same as said exterior diameter of said first end of said supply core, and a gear on said second end of said take-up core, and wherein said brake portion has a diameter larger than a diameter of said main portion of said supply core.

* * * * *